US006305116B1

(12) United States Patent
Parker

(10) Patent No.: US 6,305,116 B1
(45) Date of Patent: Oct. 23, 2001

(54) REAR GUN REST

(76) Inventor: David S. Parker, R.R. 4 Box 329J, Tyrone, PA (US) 16686

( * ) Notice: Subject to any disclaimer, the term of this patent is extended or adjusted under 35 U.S.C. 154(b) by 0 days.

(21) Appl. No.: 09/351,526

(22) Filed: Jul. 12, 1999

(51) Int. Cl.[7] ..... F41A 23/18
(52) U.S. Cl. ..... 42/94; 89/37.01; 89/37.04
(58) Field of Search ..... 42/94; 89/37.01, 89/37.04; 73/167

(56) References Cited

U.S. PATENT DOCUMENTS

| | | | | |
|---|---|---|---|---|
| 762,862 | * | 6/1904 | Phillips | 42/100 |
| 2,220,663 | * | 11/1940 | Rossmanith | 89/37 |
| 2,817,233 | * | 12/1957 | Dower et al. | 73/167 |
| 4,089,423 | * | 5/1978 | Gorham et al. | 211/64 |
| 4,625,620 | * | 12/1986 | Harris | 89/37.04 |
| 4,876,814 | | 10/1989 | Lombardo . | |
| 4,987,694 | | 1/1991 | Lombardo . | |
| 5,937,560 | * | 8/1999 | Belz | 42/94 |

FOREIGN PATENT DOCUMENTS

| | | | |
|---|---|---|---|
| 304864 | * | 2/1915 | (DE) . |
| 278402 | * | 10/1930 | (IT) . |

* cited by examiner

*Primary Examiner*—Michael J. Carone
*Assistant Examiner*—John Richardson
(74) *Attorney, Agent, or Firm*—John J. Elnitski, Jr.

(57) ABSTRACT

The present invention provides a rear gun rest that can be attached to a stock of a firearm in a permanent fashion. The rear gun rest remains on the firearm with minimal interference with the use of the firearm. The rear gun rest includes a main tube pivotally connected to said stock. The main tube includes a pivot pin as part of the main tube, a retaining pin as part of the main tube and at least one tension spring connected between said pivot pin and said retaining pin. The pivot pin allows the pivoting of the main tube. The tension spring aids in retaining the main tube in a desired position. The rear gun rest also includes an extension tube and a fine adjustment rod for adjusting the height of the stock. The extension tube is extendible from the main tube. The fine adjustment rod is extendible from the extension tube.

18 Claims, 12 Drawing Sheets

REAR GUN REST

BACKGROUND

There are many gun rests available on the market that are used for steadying a firearm during its firing. The majority of gun rests available are either a front gun rest for supporting the forearm of the firearm or a full gun rest for supporting both the forearm and stock of the firearm. There is a less abundance of rear gun rests available for supporting only the stock of the firearm. The majority of full gun rests are used only at firing ranges to sight in the firearm, due to their bulk and cumbersome nature. While, the majority of the front gun rests are used in the field for applications such as hunting or police work. The majority of the rear gun rests, are used with front gun rests to sight in the firearm. The majority of these rear gun rests are usually too bulky and cumbersome for use in the field. What is needed is a rear gun rest which is not bulky or cumbersome, so it can be used both at the firing range and in the field.

SUMMARY OF THE INVENTION

The present invention provides a rear gun rest for mounting to a stock of a firearm. The rear gun rest includes a main tube pivotally connected to said stock. The main tube includes a pivot pin as part of the main tube, a retaining pin as part of the main tube and at least one tension spring connected between said pivot pin and said retaining pin. The pivot pin allows the pivoting of the main tube. The tension spring aids in retaining the main tube in a desired position. The rear gun rest also includes an extension tube and a fine adjustment rod for adjusting the height of the stock. The extension tube is extendible from the main tube. The fine adjustment rod is extendible from the extension tube.

DETAILED DESCRIPTION

Figure 1:
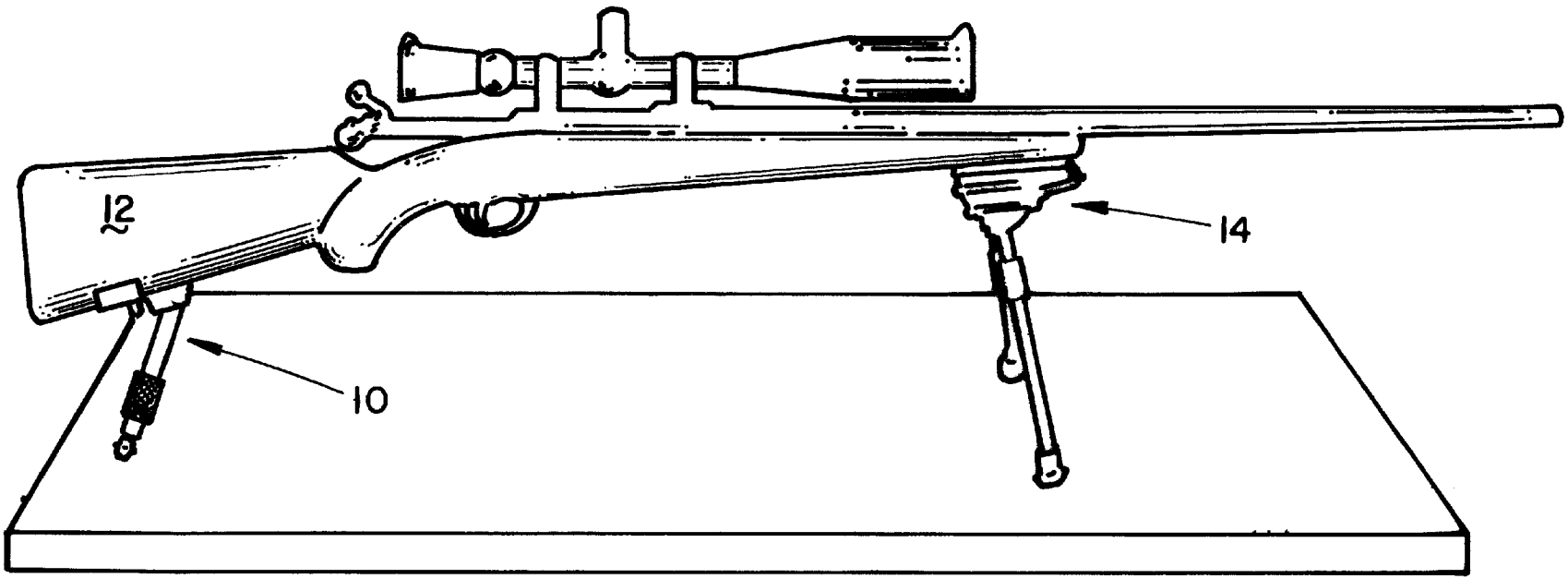
FIG. 1 is a perspective view of a rear gun rest attached to a stock of a firearm according to the present invention.
Figure 2:
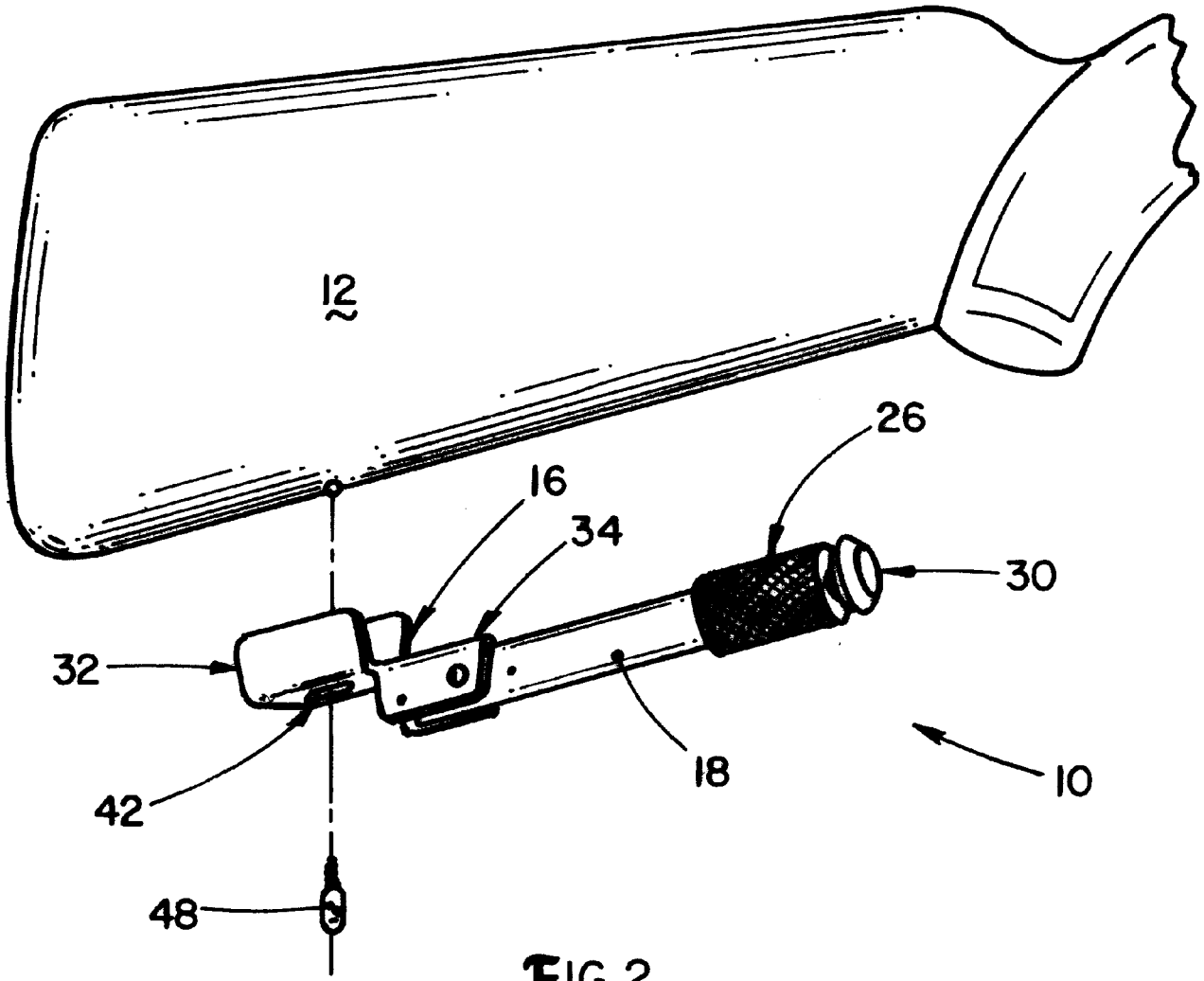
FIG. 2 is a perspective view of the rear gun rest of FIG. 1 being mounted to the stock.
Figure 3:
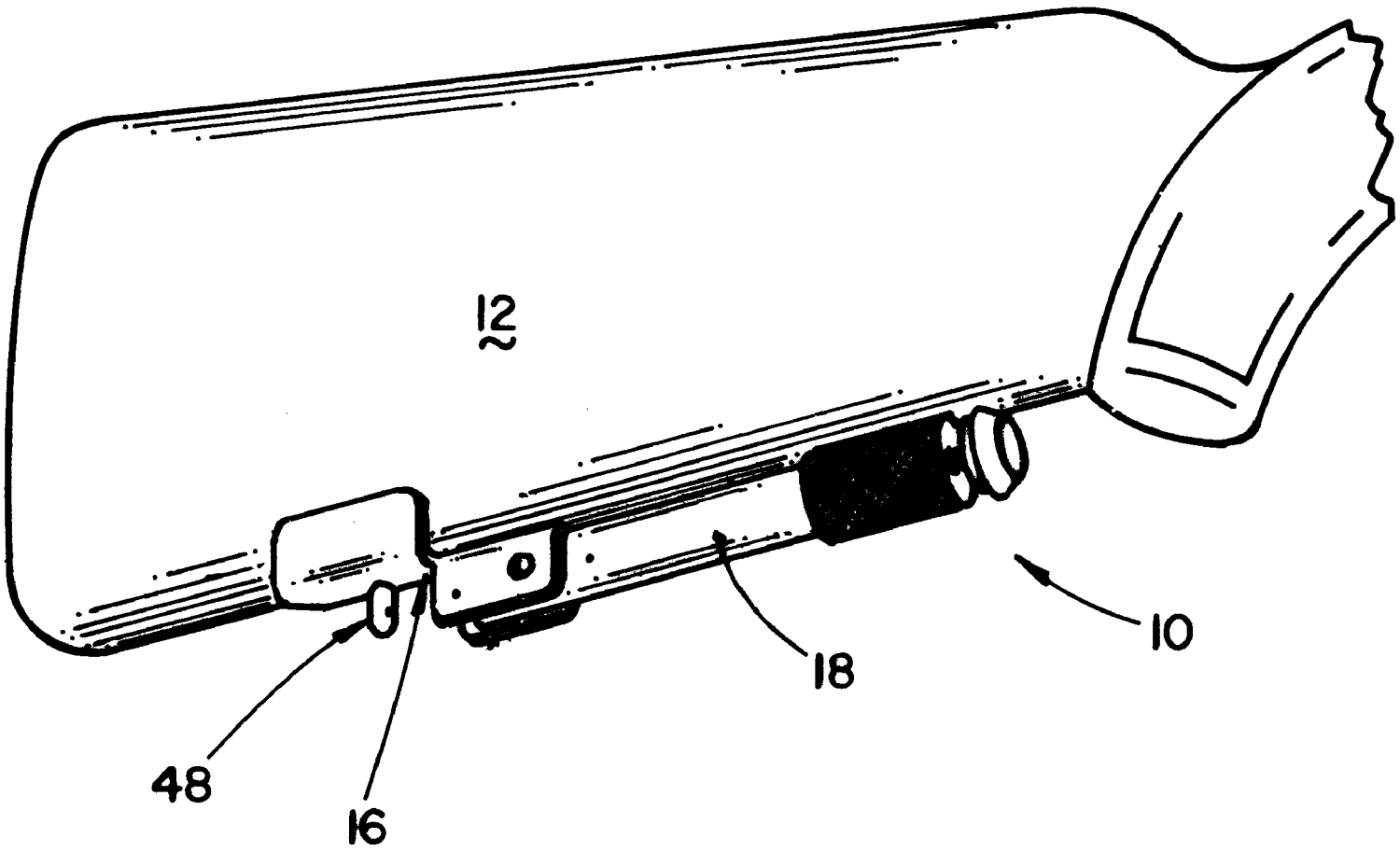
FIG. 3 is a perspective view of the rear gun rest of FIG. 1 in the home position.
Figure 4:
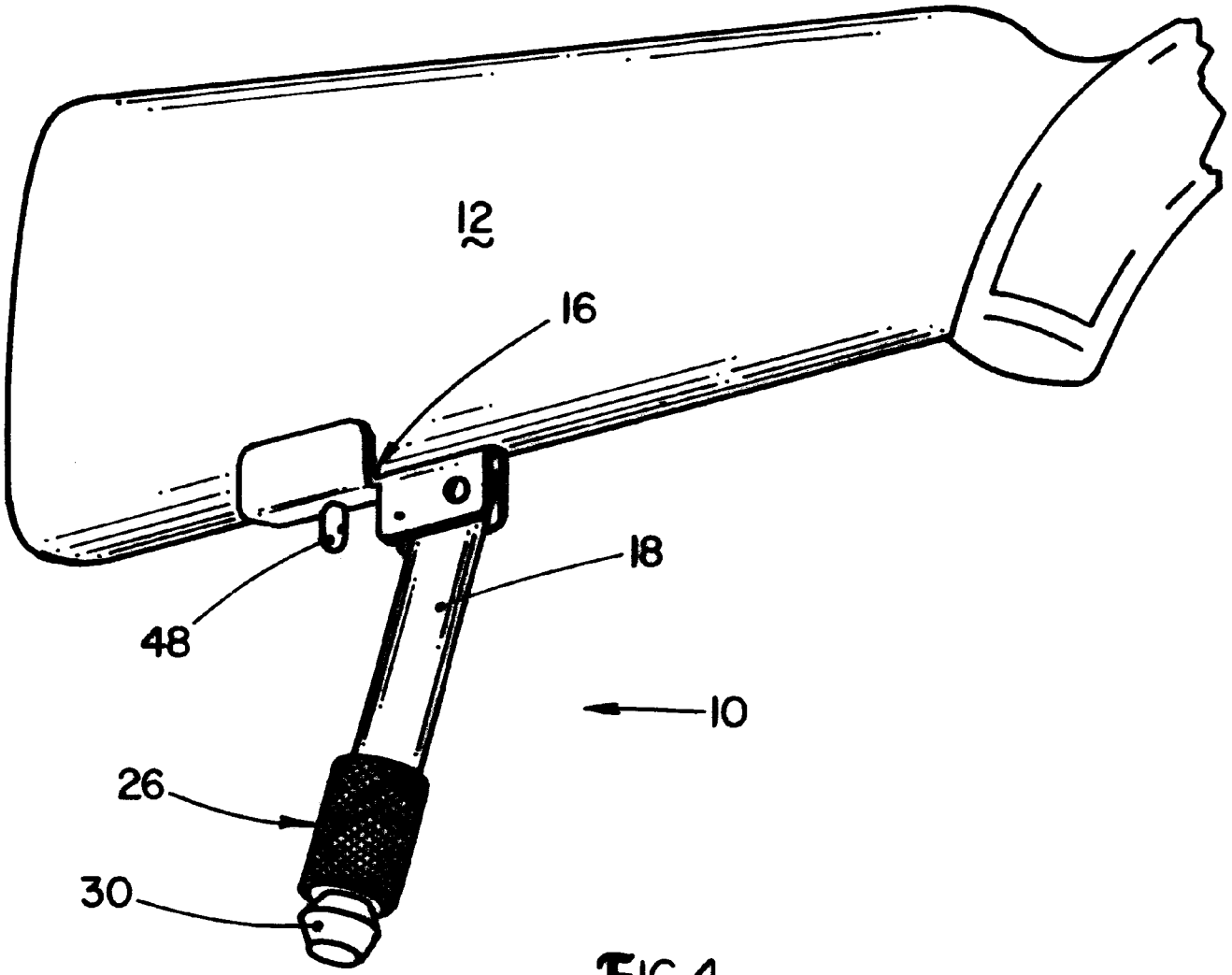
FIG. 4 is a perspective view of the rear gun rest of FIG. 1 in the shooting position.
Figure 5:
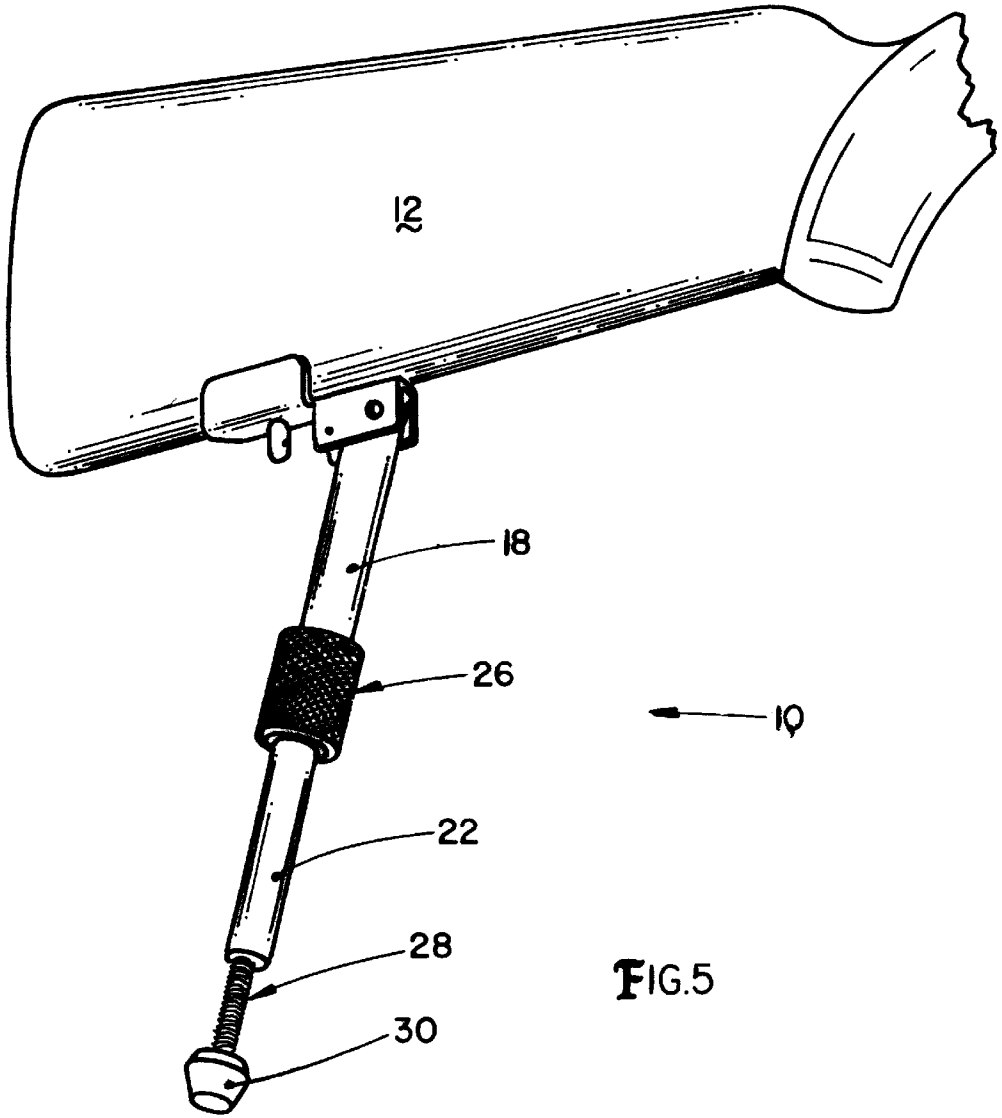
FIG. 5 is a perspective view of the rear gun rest of FIG. 1 in the shooting position when fully extended.

The present invention is a rear gun rest 10 that can be attached to a stock 12 of a firearm in a permanent fashion. The rear gun rest 10 remains on the firearm with minimal interference with the use of the firearm. FIG. 1 shows the rear gun rest 10 of the present invention mounted to the stock 12 of a firearm along with a front gun rest 14. FIGS. 2–5 show a closer view of the rear gun rest 10 and stock 12 of a firearm. FIG. 2 shows the mounting of the gun rest to a stock 12 of the firearm by screwing it to the stock 12. FIG. 3 shows the rear gun rest 10 in a home position, when the rear gun rest 10 in not needed. FIG. 4 shows the rear gun rest 10 in a shooting position and ready for use. FIG. 5 shows the rear gun rest 10 fully extended in the shooting position.

Figure 6:
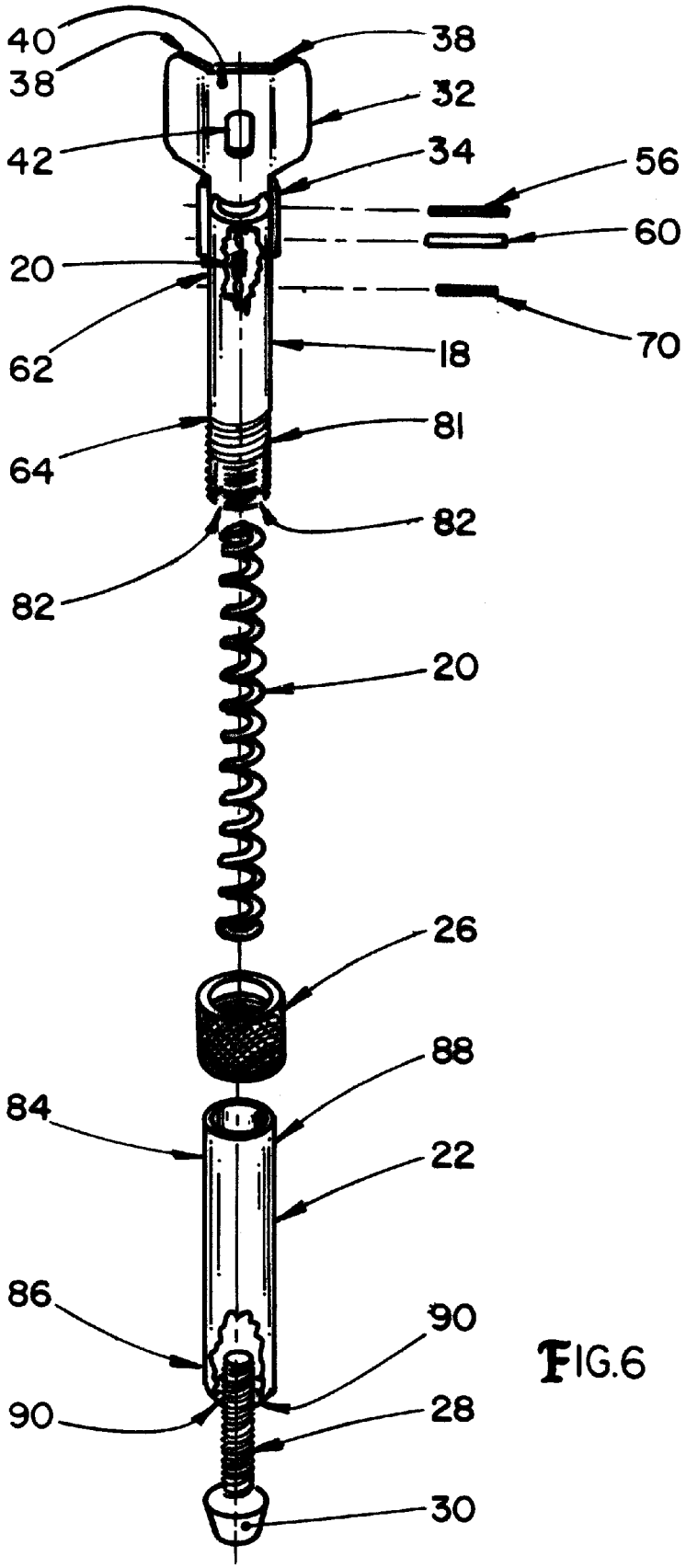
FIG. 6 is exploded view of the rear gun rest of FIG. 1.
Figure 7:
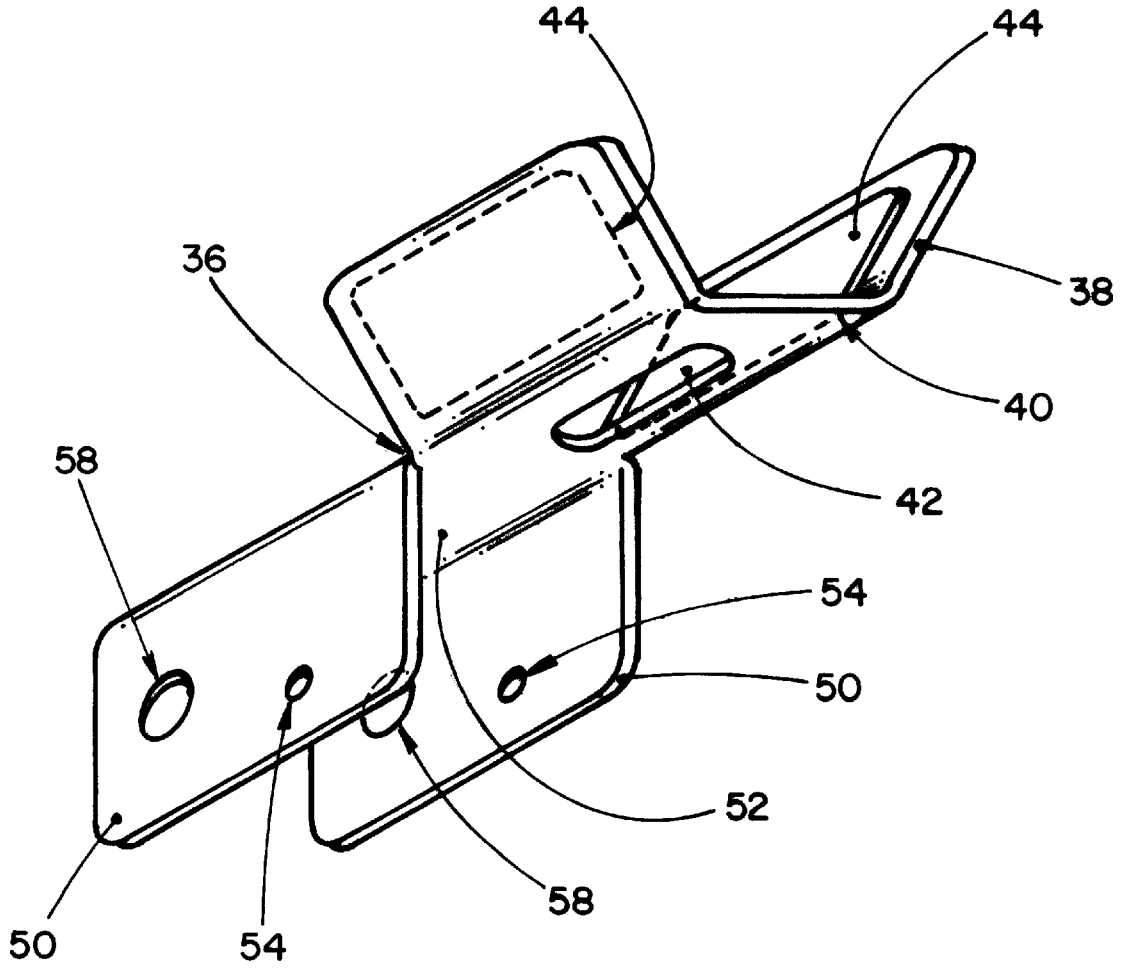
FIG. 7 is a perspective view of a mounting bracket of the rear gun rest of FIG. 1.

The gun rest includes a mounting bracket 16, main tube 18, tension spring 20, extension tube 22, extension spring 24, locking nut 26, threaded fine adjustment rod 28 and a rubber foot 30, as shown in FIG. 6. As shown in FIGS. 6–7, the mounting bracket 16 includes a stock mount end 32 on one end of the mounting bracket 16 and a main tube mount end 34 on the other end of the mounting bracket 16. The stock mount end 32 and main tube mount end 34 are shown connected by a mid-section 36. The stock mount end 32 is shown in a semi-V shape configuration having two sides 38 and a bottom 40. The bottom 40 of the stock mount end 32 includes a slot 42 and each of the sides 38 include an anti-marring pad 44. The inside 46 of the semi-V shape fits over the outside bottom of the stock 12. The slot 42 allows for the securing of the semi-V shape to the stock 12 by using a fastener such as a sling mounting screw 48 which passes through the slot 42 and screws into the stock 12. Most stocks include a sling mounting screw 48 that has an end for receiving hardware of a sling. The sling mounting screw 48 can be substituted by any type of screw or other similar fastener. The main tube mount end 34 allows for attachment of the main tube 18. The main tube mount end 34 is shown in a U-shaped configuration which extends in the opposite direction of the stock mount end 32 and has two sides 50 and a bottom 52. The main tube mount end 34 includes a pair of aligned stop pin holes 54 for receiving a stop pin 56. The main tube mount end 34 also includes a pair of aligned pivot pin holes 58 for receiving a pivot pin 60.

Figure 8:
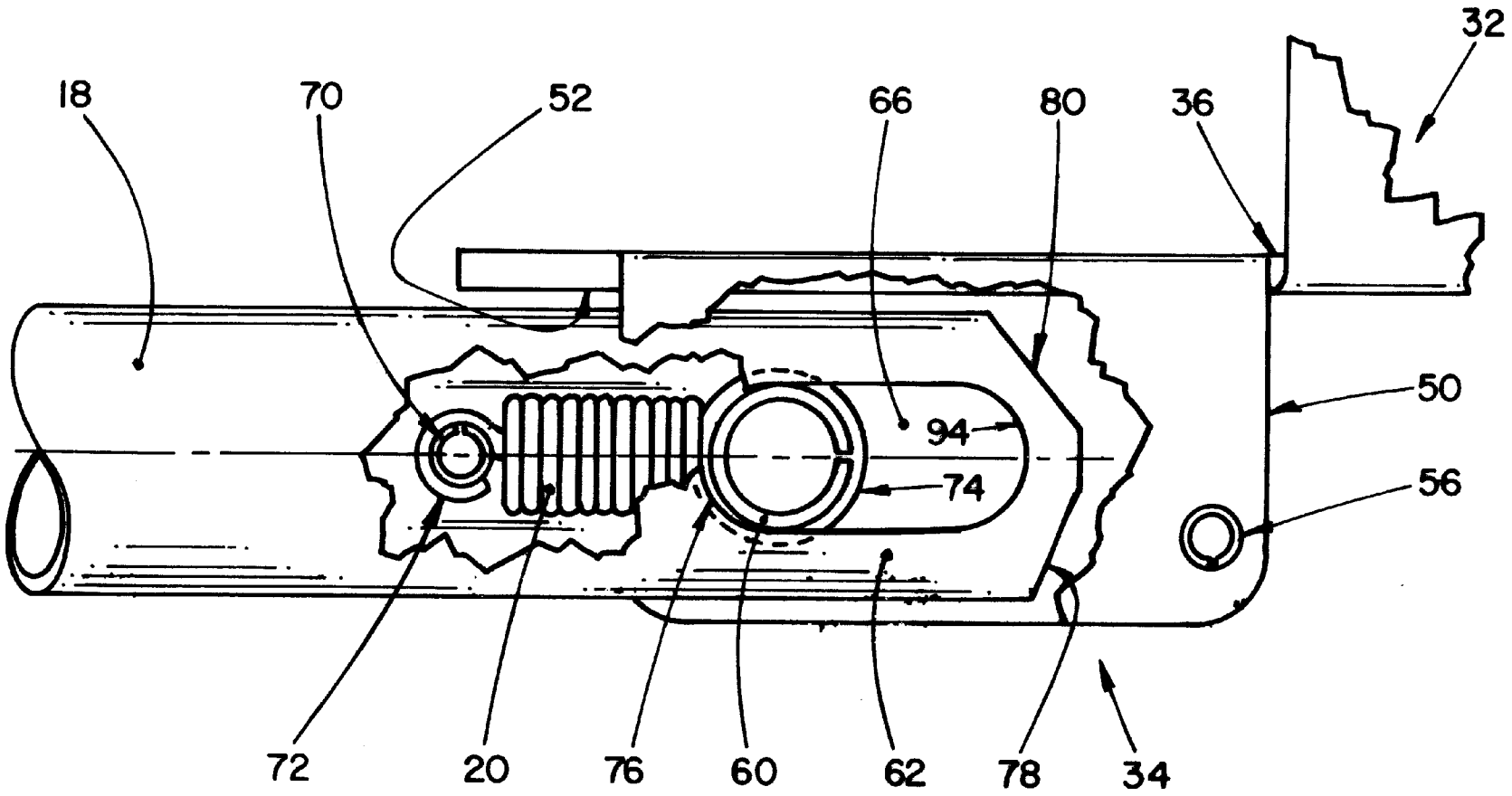
FIG. 8 is a cut-away side view the mounting bracket and a main tube of the rear gun rest of FIG. 1.
Figure 9:
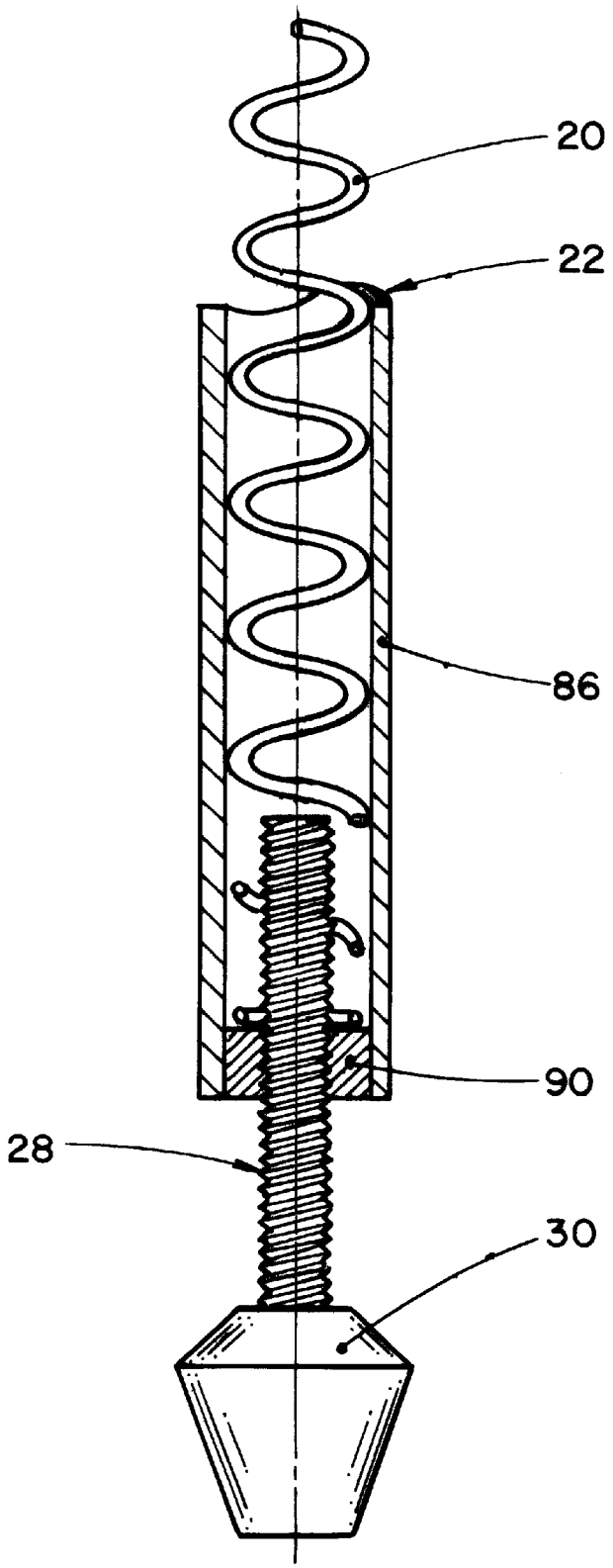
FIG. 9 is a cut-away side view an extension tube of the rear gun rest of FIG. 1.

The main tube 18 includes a pivot end 62 and an extension end 64, as shown in FIGS. 6, 8, and 10–12. The pivot end 62 includes a pair of aligned pivot pin slots 66, a pair of aligned retaining pin holes 68 and the tension spring 20. The retaining pin holes 68 are for receiving a retaining pin 70. The tension spring 20 includes a first end 72 for receiving the retaining pin 70 and a second end 74 for receiving the pivot pin 60, whereby the tension spring 20 is held in place by the retaining pin 70 and pivot pin 60. The pivot end 62 is attached to the main tube mount end 34 placing the pivot end 62 within the U-shape of the main tube mount end 34. The pivot end 62 is secured to the main tube mount end 34 by aligning the pivot pin slots 66 with the pivot pin holes 58 and inserting the pivot pin 60 through the pivot pin slots 66 and holes 58. The pivot pin 60 is also inserted through the second end 74 of the tension spring 20 as it is inserted through the pivot pin holes 58 of the main tube 18. The retaining pin 70 is inserted into the main tube 18 and the first end 72 of the tension spring 20. All of the pins are about the same size as the holes they are inserted into and are slotted as shown in FIG. 8 so their diameter can be compressed and pressure fitted into the holes. When assembled, the tension spring 20 pulls the main tube 18 rearward in relation to the firearm, such that a first end 76 of each pivot slot 66 is pulled against the pivot pin 60, thereby placing the main tube 18 in the home position. The pivot end 62 is shaped as shown in FIGS. 8 and 10–12 and has an angled stop surface 78 and an angled clearance surface 80. The outside of the extension end 64 is threaded with threads 81 to receive the locking nut 26 and includes compression slots 82.

The extension tube 22 includes a flared end 84 and foot end 86. The flared end 84 includes an outside flare 88 which passes inside the extension end 64 of the main tube 18. The foot end 86 includes a threaded plug 90 to receive the threaded fine adjustment rod 28. The extension spring 24 is placed into the extension tube 22. The flare 88 of the extension tube 22 is placed into the main tube 18 at the extension end 64. The extension spring 24 is thereby trapped between the retaining pin 70 and the threaded plug 90. The locking nut 26 is slipped over the foot end 86 and threaded onto the threads 81 of the extension end 64. The locking nut 26, when tighten, compresses the extension end 64 against the extension tube 22 due to the compression slots 82, thereby locking the extension tube 22 in place. Also, once the locking nut 26 is initially threaded on the extension end 64, the extension tube 22 is secured, as the flare 88 will not pass the initial compression of the extension end 64. The threaded fine adjustment rod 28 is screwed into the threaded plug 90 and the rubber foot 30 is secured to the threaded fine adjustment rod 28 where shown in FIGS. 1–14.

Figure 10:
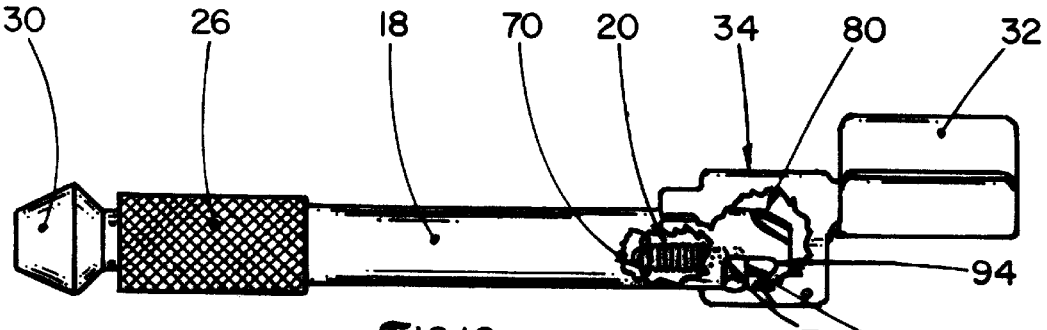
FIG. 10 is a perspective view of the main tube of the rear gun rest of FIG. 1 in the home position.
Figure 11:
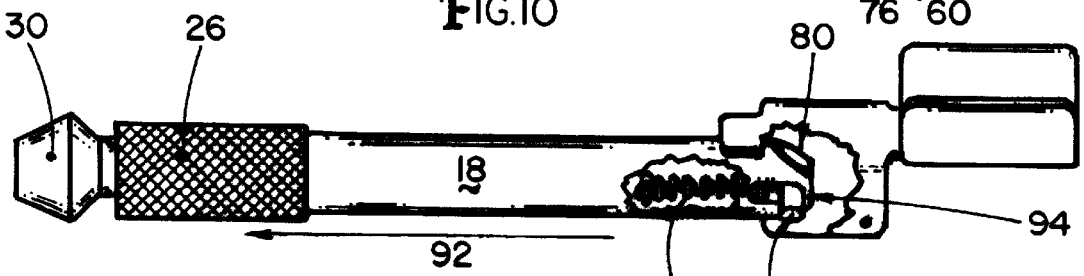
FIG. 11 is a perspective view of beginning movement of the main tube of the rear gun rest of FIG. 1 from the home position.
Figure 12:
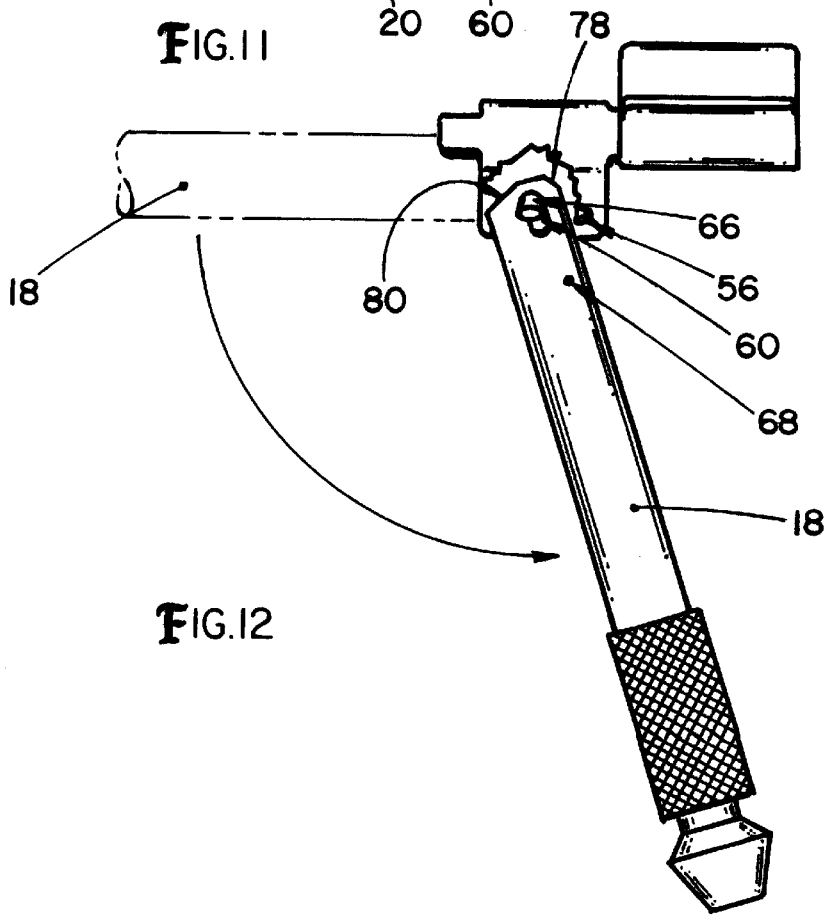
FIG. 12 is a perspective view of rotation the main tube of the rear gun rest of FIG. 1 from the home position to the shooting position.

Operation of the gun rest is as shown in FIGS. 10–12. FIG. 10 shows the main tube 18 in the home position. In the home position, the main tube 18 can not be pivoted as the pivot end 62 abuts against the main tube mount end 34 of the mounting bracket 16. FIG. 11 shows the main tube 18 being pulled away from the pivot pin 60 in the forward direction of the firearm, as shown by arrow 92. When pulled as shown in FIG. 11, the main tube 18 travels until the pivot pin 60 contacts a second end 94 of each pivot pin slot 66. When the main tube 18 is position as shown in FIG. 11, the main tube 18 can be pivoted against the stop pin 56 as shown in FIG. 12. The stop pin 56 functions to prevent further pivoting of the main tube 18. The main tube 18 can be pivoted due to the angled clearance surface 80 providing the necessary clearance away from the bottom 52 of the main tube mount end 34, when the main tube 18 is in the position shown in FIG. 11. When the main tube 18 is released in the position shown in FIG. 12, the tension spring 20 pulls the main tube 18 towards the main tube mount end 34 of the mounting bracket 16 until the angled stop surface 78 contacts the bottom 52 of the main tube mount end 34. When the angled stop surface 78 contacts the bottom 52 of the main tube mount end 34 and the main tube 18 is against the stop pin 56, the rear gun rest 10 is in the shooting position. To return the main tube 18 to the home position, the main tube 18 is pivoted in the reverse direction until it locks in place as shown in FIG. 10. The height of the stock 12 in FIG. 1 can be adjusted using the extension tube 22 for coarse adjustment and using the threaded fine adjustment rod 28 for fine adjustment. For coarse adjustment of stock height, the locking nut 26 is loosened to release the extension tube 22, whereby the extension spring 24 forces the extension tube 22 to extend outward away from the main tube 18. After the extension tube 22 is extended the desired amount, the locking nut 26 is tighten to lock the extension tube 22 in place. For fine adjustment of stock height, the threaded fine adjustment rod 28 is screwed in or out of the threaded plug 90.

Figure 13:
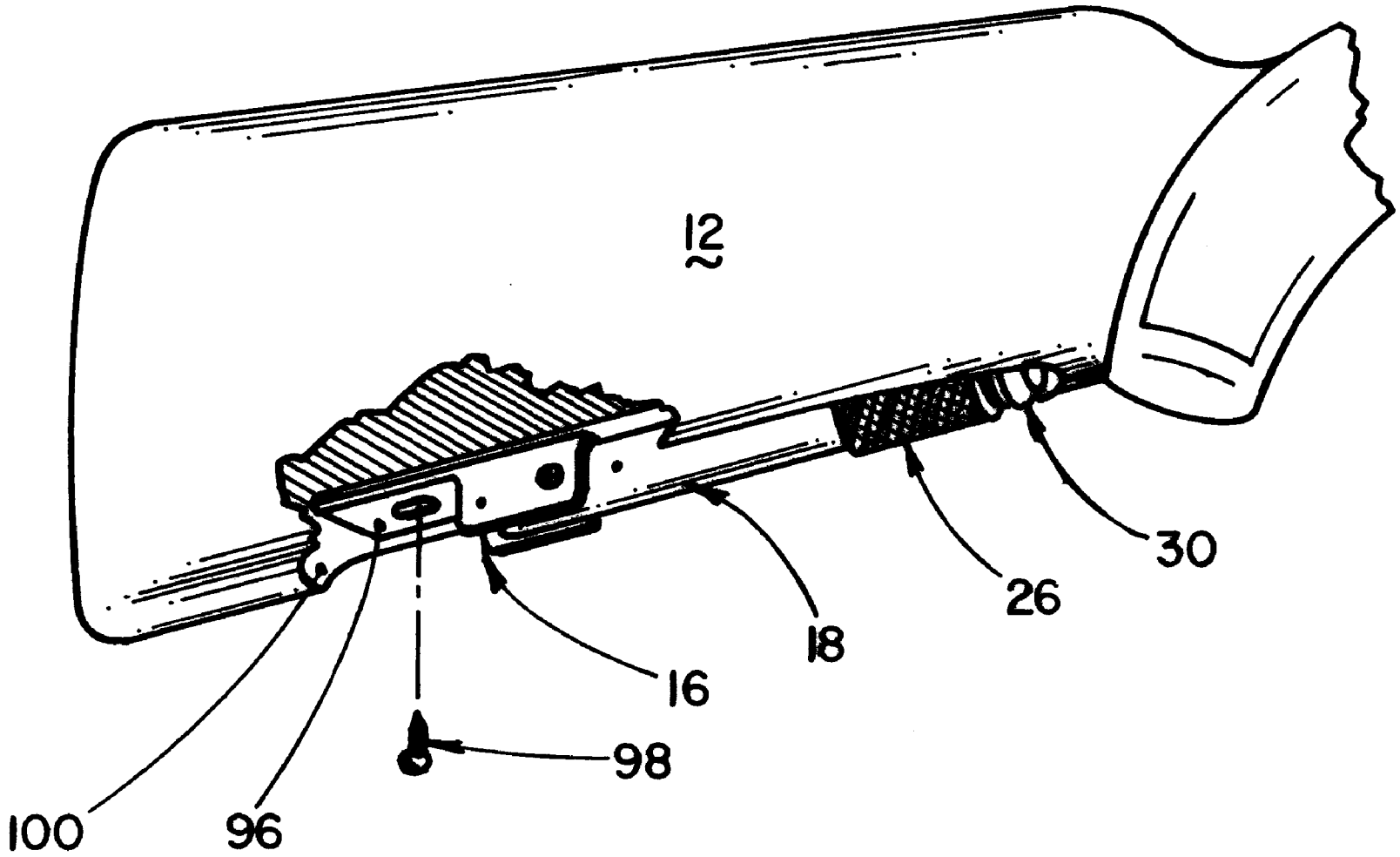
FIG. 13 a perspective view of the rear gun rest of FIG. 1 with a different mounting bracket.
Figure 14:
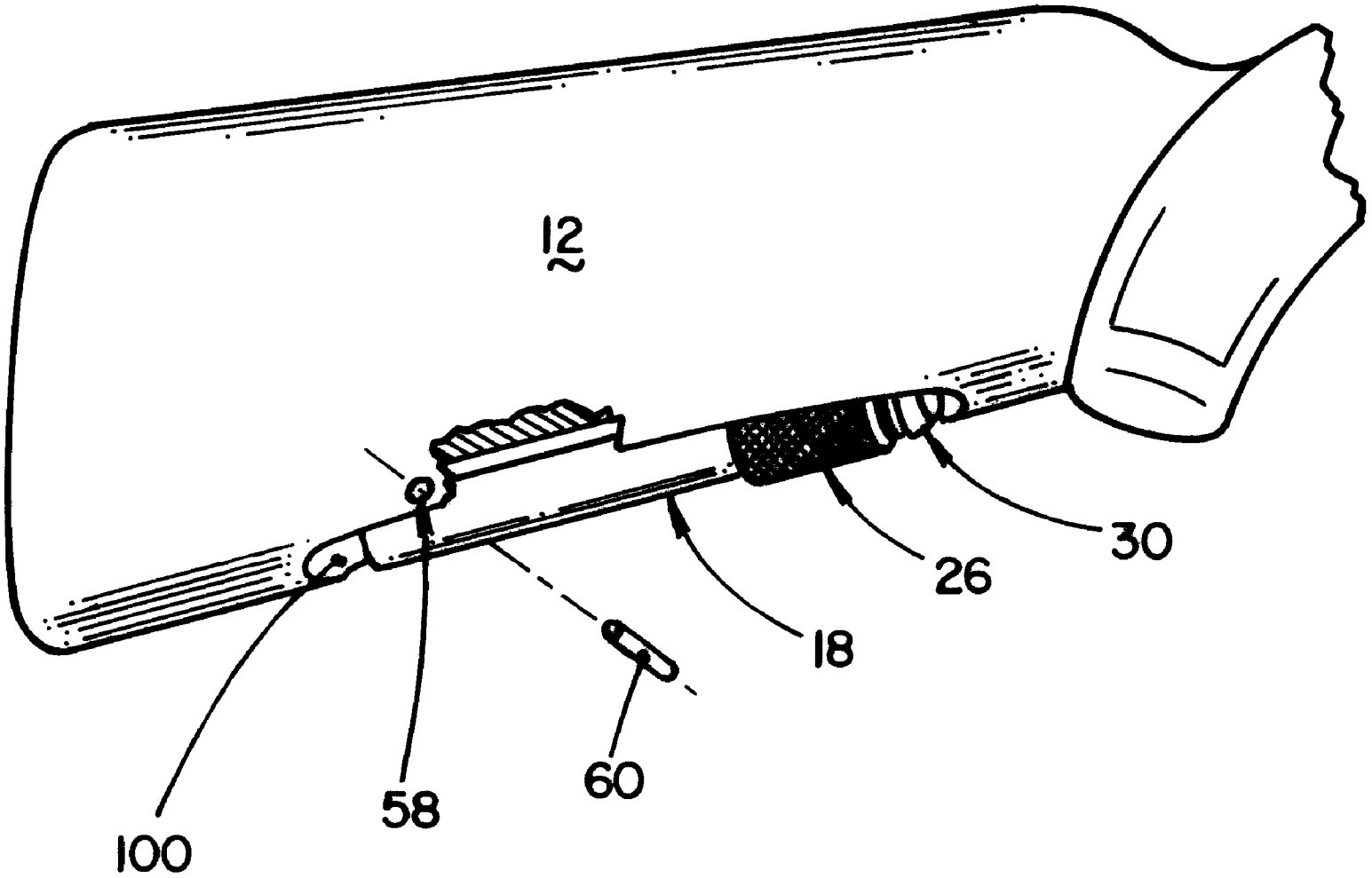
FIG. 14 is a perspective view of the rear gun rest of FIG. 1 with no mounting bracket.

Another embodiment is envisioned where the mounting bracket 16 is modified or not used at all. The gun rest is shown mounted inside the stock 12 of the firearm in FIGS. 13–14. FIG. 13 shows the semi-V shaped replaced by a flat shape 96 for the stock mount end 32, whereby the flat shape 96 is secured by a screw 98 into the stock 12 via the slot 42. FIG. 14 shows the main tube 18 mounted inside the stock 12 without the use of the mounting bracket 16. Here the pivot pin holes 58 would be part of the stock 12 and the mounting bracket 16 is not needed. For both cases, the stop pin 56 (not shown) could be used in the stock 12 or the inside rear surface 100 of the stock 12 itself could perform the function of the stop pin 56. In either of the above cases the main tube 18 and extension tube 22 would operate in the same manner as described above.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A rear gun rest for mounting to a stock of a firearm comprising:

a main tube having a first end and a second end;

said first end of the main tube being pivotally connected to said stock;

said second end of the main tube for supporting the stock from a surface;

an extension tube having a first end and a second end, said second end of said extension tube extendible from said second end of said main tube and adjustable as to the amount of extension from said second end of said main tube;

said second end of said main tube threaded to receive a nut; and said second end of the main tube compressible by said nut in order to secure said extension tube in a position relative to said main tube.

2. The rear gun rest of claim 1, further including a fine adjustment rod which extends from said second end of said main tube and is adjustable as to the amount of extension from said second end.

3. The rear gun rest of claim 2, wherein said fine adjustment rod is threaded and said second end of said main tube is threaded to receive said fine adjustment rod.

4. The rear gun rest of claim 1, wherein said extension tube includes a flare to restrict removal of said extension tube from said main tube.

5. The rear gun rest of claim 1, further including a fine adjustment rod which extends from said second end of said extension tube and is adjustable as to the amount of extension from said second end of said extension tube.

6. The rear gun rest of claim 1, further including a mounting bracket having a stock mount end and main tube mount end, said stock mount end including a hole for attachment of said mounting bracket to said stock by a fastener and said main tube mount end including a pair of aligned pivot holes for receiving said pivot pin between said aligned pivot holes.

7. The rear gun rest of claim 6, wherein said main tube end mount is a U-shaped defined by two sides and a bottom, wherein said first end of said main tube is positioned within an area defined by said sides and bottom of said U-shape, and wherein each of said sides includes one of said pair of aligned pivot holes.

8. The rear gun rest of claim 6, wherein said stock mount end is a semi-V shape defined by two sides and a bottom, wherein said bottom includes a hole to receive a fastener for mounting said stock mount end to said stock and said sides of said semi-V shape surround sides of said stock to prevent movement of said mounting bracket.

9. The rear gun rest of claim 6, wherein said stock mount end is a flat shape for mounting to a bottom of said stock.

10. The stock with gun rest of claim 1, further including a stop pin to restrict movement of said main tube.

11. A rear gun rest for mounting to a stock of a firearm comprising:

a main tube having a first end and a second end;

said first end of the main tube being pivotally connected to said stock;

said second end of the main tube for supporting the stock from a surface; and a pivot pin as part of said main tube about which said main tube pivots about the stock, a retaining pin as part of the main tube and at least one tension spring connected between said pivot pin and said retaining pin.

12. The rear gun rest of claim 11, further including an extension tube having a first end and a second end, said second end of the extension tube extendible from said second end of the main tube and adjustable as to the amount of extension from said second end of the main tube.

13. The rear gun rest of claim 12, wherein said second end of the main tube is threaded to receive a nut and wherein said second end of the main tube is compressible by said nut in order to secure said extension tube in a position relative to said main tube.

14. The rear gun rest of claim 11, further including a pair of aligned pivot pin slots at said first end of said main tube and wherein said pivot pin is not fixed to said main tube but can move linearly along said pair of aligned pivot pin slots.

15. The stock with gun rest of claim 11, further including an extension tube having a first end and a second end, said second end of the extension tube extendible from said second end of the main tube and adjustable as to the amount of extension from said second end of the main tube.

16. The stock with gun rest of claim 15, wherein said second end of the main tube is threaded to receive a nut and wherein said second end of the main tube is compressible by said nut in order to secure said extension tube in a position relative to said main tube.

17. The stock with gun rest of claim 16, further including a pair of aligned pivot pin slots at said first end of said main tube and wherein said pivot pin is not fixed to said main tube but can move linearly along said pair of aligned pivot pin slots.

18. A stock with gun rest for a firearm comprising:

a stock;

a main tube having a first end and a second end mounted within said stock;

said first end of the main tube being pivotally connected to said stock;

said second end of the main tube for supporting the stock from a surface; and an extendible tube inside said main tube.

* * * * *